US011905723B2

(12) United States Patent
Russell

(10) Patent No.: US 11,905,723 B2
(45) Date of Patent: Feb. 20, 2024

(54) SCAFFOLDING

(71) Applicant: James Russell, Nederland, TX (US)

(72) Inventor: James Russell, Nederland, TX (US)

( * ) Notice: Subject to any disclaimer, the term of this patent is extended or adjusted under 35 U.S.C. 154(b) by 339 days.

(21) Appl. No.: 17/175,066

(22) Filed: Feb. 12, 2021

(65) Prior Publication Data

US 2021/0254352 A1 Aug. 19, 2021

Related U.S. Application Data

(60) Provisional application No. 62/978,655, filed on Feb. 19, 2020.

(51) Int. Cl.

| | |
|---|---|
| ***E04G 3/24*** | (2006.01) |
| ***E04G 5/04*** | (2006.01) |
| ***E04G 5/06*** | (2006.01) |
| ***E04G 7/02*** | (2006.01) |

(52) U.S. Cl.

CPC ..... *E04G 3/24* (2013.01); *E04G 5/045* (2013.01); *E04G 5/061* (2013.01); *E04G 5/067* (2013.01); *E04G 7/02* (2013.01)

(58) Field of Classification Search

CPC ..... E04G 3/24; E04G 5/045; E04G 5/061; E04G 5/067; E04G 7/02; E04G 3/243; F16L 3/00; B66F 7/02; B66F 7/28; E01D 19/106; E01D 19/16; E01D 11/02; B66C 1/16; B66C 1/12; B66C 1/62; F16B 2/02; F16B 7/0493; B63C 2005/025; B63C 5/02; E02B 17/0034; Y10T 24/1457

See application file for complete search history.

(56) References Cited

U.S. PATENT DOCUMENTS

| | | | |
|---|---|---|---|
| 1,805,006 | A | 5/1931 | Neilon |
| 1,853,010 | A | 4/1932 | Wray |
| 2,071,632 | A | 2/1937 | Hollis |
| 2,087,155 | A | 7/1937 | Lee |
| 2,191,643 | A | 2/1940 | Deckard |
| 2,257,520 | A | 9/1941 | York |
| 2,410,836 | A | 11/1946 | Neale |
| 2,507,040 | A | 5/1950 | Moore |
| 2,738,076 | A | 3/1956 | Porter |
| 2,917,181 | A | 12/1959 | Staub |
| 2,926,880 | A | 3/1960 | Bourgeois |

(Continued)

FOREIGN PATENT DOCUMENTS

| | | |
|---|---|---|
| CN | 207554963 | 6/2018 |
| EP | 3095750 | 11/2016 |

(Continued)

*Primary Examiner* — Jessica L Laux
*Assistant Examiner* — Jacob G Sweeney
(74) *Attorney, Agent, or Firm* — Werner IP Law, P.C.

(57) ABSTRACT

A scaffolding assembly adapted to be releasably attached to an elongate support member such as an overhead pipe. The scaffolding assembly has a split collar and a platform assembly adapted to be releasably attached to the split collar. The split collar comprises at least two segments which can encircle the pipe and be secured to one another. The platform assembly which includes a platform deck has a connector formation which extends laterally outwardly from the deck to an extent that it can engage a receiving formation on the collar assembly and thereby attach the platform assembly to the collar assembly.

11 Claims, 10 Drawing Sheets

(56) References Cited

U.S. PATENT DOCUMENTS

| | | | | |
|---|---|---|---|---|
| 3,184,273 | A | 5/1965 | Blough | |
| 3,735,951 | A | 5/1973 | Reed | |
| 4,276,959 | A | 7/1981 | Barber | |
| 5,018,768 | A * | 5/1991 | Palatchy | F16L 23/10 285/24 |
| 5,337,855 | A | 8/1994 | File | |
| 5,524,727 | A | 6/1996 | Yennie, Jr. | |
| 6,494,291 | B2 | 12/2002 | Ono | |
| 6,666,298 | B2 | 12/2003 | Volkman | |
| 7,264,083 | B2 | 9/2007 | Wilcox | |
| 9,103,081 | B1 * | 8/2015 | Mangin | E01D 22/00 |
| 9,874,297 | B2 | 1/2018 | Campbell et al. | |

FOREIGN PATENT DOCUMENTS

| | | | | |
|---|---|---|---|---|
| GB | 2261465 A * | 5/1993 | | C01B 13/02 |
| JP | H0662097 | 9/1994 | | |
| KR | 20190014789 | 2/2019 | | |

* cited by examiner

SCAFFOLDING

CROSS-REFERENCE TO RELATED APPLICATION

This application claims priority to U.S. Application No. 62/978,655 filed on Feb. 19, 2020, the disclosure of which is incorporated herein by reference for all purposes.

FIELD OF THE INVENTION

The present invention relates to scaffolding and, more particularly, to scaffolding which can be suspended from vertical or elevated horizontal pipes.

BACKGROUND OF THE INVENTION

A wide variety of scaffolding is used extensively in the construction and maintenance industries. As well-known typical scaffolding comprises a platform from which extends legs, which can rest upon a floor, slab or the like, such that the platform is elevated. This prior art scaffolding of necessity requires floor space since the feet or legs of the scaffolding must engage the floor for support.

Refineries and chemical plants are continuously undergoing maintenance, renovation, or new construction. The vessels, piping, valving, and structures that make up even a single typical process unit dramatically restrict the amount of available slab/floor space.

By their very nature, refineries, chemical plants and similar installations are replete with extensive piping. In this regard, there are pipe racks providing support surfaces for piping which runs generally horizontally through the facility. As well, pipes have runs which extend vertically.

SUMMARY OF THE INVENTION

In one aspect the present invention relates to a scaffolding assembly which can be suspended from a horizontally extending tubular member.

In another aspect, the present invention relates to a scaffolding assembly which can be suspended from a horizontally extending elongate support such as a pipeline carrying fluids.

In a further aspect, the present invention relates to a scaffolding assembly which can be suspended from a horizontally extending pipeline carrying fluids, wherein the pipeline is protected from scoring, notching or other damage to the surface of the pipe which could compromise the pipe's structural integrity.

In yet another aspect, the present invention relates to a scaffolding assembly which can be suspended from elevated horizontally running pipelines.

In still a further aspect, the present invention relates to a scaffolding assembly which can be suspended from laterally spaced elongate supports which are of different diameters.

In yet a further aspect, the present invention relates to a scaffolding assembly which can be suspended from a vertically extending elongate support.

In another aspect, the present invention relates to a scaffolding assembly wherein one or more segments of the scaffolding platform can be suspended from a vertically extending elongate support.

These and further features and advantages of the present invention will become apparent from the following detailed description, wherein reference is made to the figures in the accompanying drawings.

DETAILED DESCRIPTION OF PREFERRED EMBODIMENTS

Figure 1:
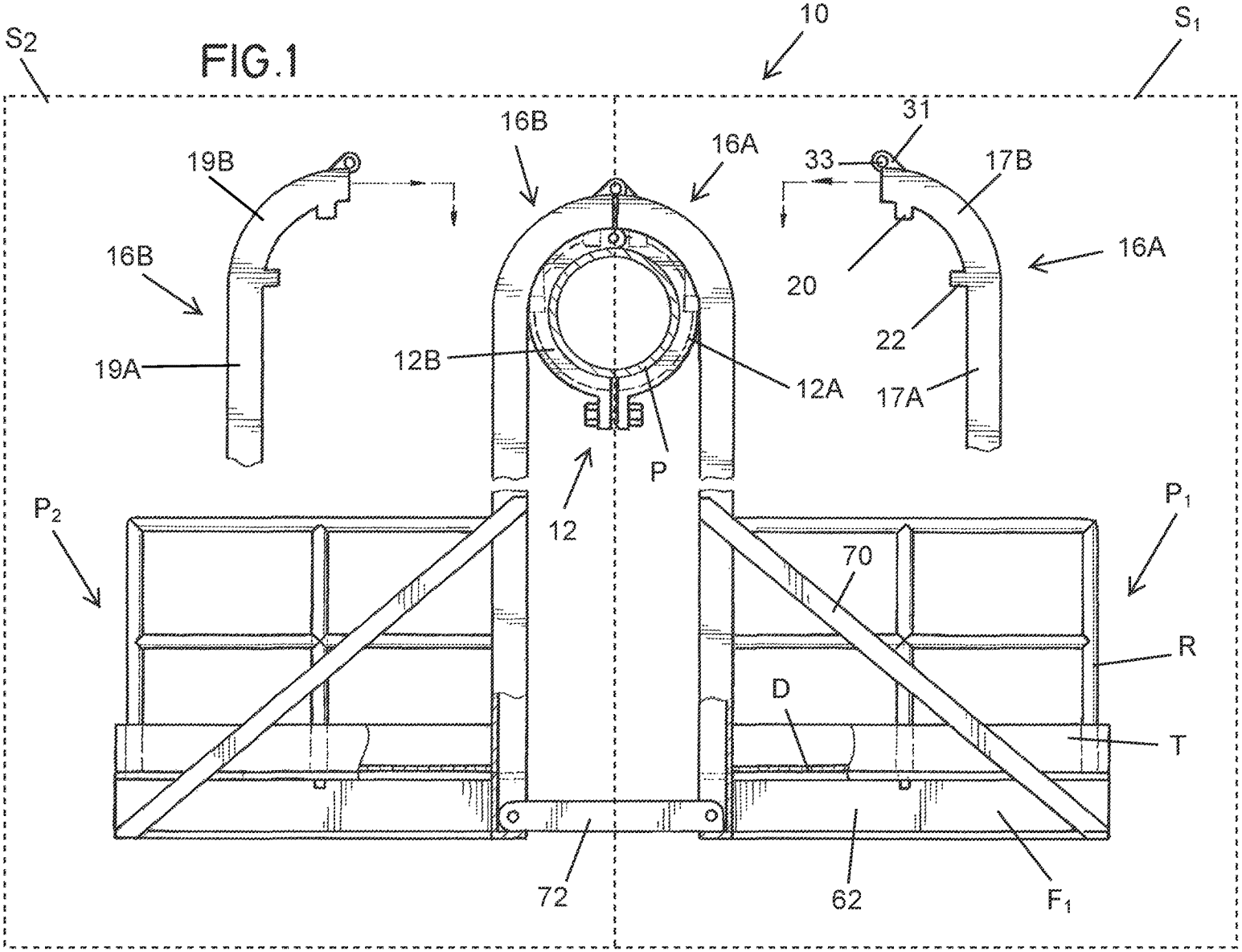
FIG. 1 is a front elevational view of one embodiment of the scaffolding assembly of the present invention.

As used herein the term "horizontal" means generally horizontal and does not require perfectly horizontal orientation.

As used herein the term "vertical" means generally vertical and does not require perfectly vertical orientation.

The terms "support," "elongate support," "support member(s)," or variations thereof refer to a structural member, generally elongate in nature, but which can have any cross-sectional shape or configuration. Thus, the support can comprise a tubular member, a bar having various cross-sectional shapes, an I-beam, a channel member, etc.

In the description which follows in describing the scaffolding assembly of the present invention, reference will be made to a "split collar." The term is intended to mean a structure for encircling a cylindrical object, e.g, a tubular member, albeit that it be in two or more segments. Thus, although the split collar of the present invention is segmented, it may still be referred to as a collar, albeit that there may be spaces between the individual segments. In other words, the word "collar" is inclusive of a structure with two or more segments, i.e., a split collar. Although as depicted in the drawings and as described hereafter, in one embodiment the collar of the present invention is generally circular in cross-section. However, just as the support members can have various cross-sectional profiles, the split collar can likewise have various cross-sectional shapes depending on the cross-sectional shape of the support or support member. Additionally, the outer surfaces of the collar may not be arcuate as shown in the drawings and described hereafter. Rather, the outside surface of the collar need only be adapted to receive the yoke assemblies.

Referring first to FIGS. 1-4, an embodiment of the present invention, shown generally as 10, comprises six main components, first and second collars shown generally as 12 and 14, first and second yokes shown generally as 16 and 18, and first and second platforms $P_1$ and $P_2$. Since the respective pairs of the collars, yokes, and platforms are the same, only one of each will be described in detail.

Collar 12 comprises first and second collar segments 12A and 12B, while yoke 16 comprises first and second yoke sections 16A and 16B. Each of the yoke sections 16A and 16B comprises a substantially straight portion forming a first run and an arced portion forming a second run. Thus, yoke section 16A has a substantially straight first run 17A and an arced second run 17B, while yoke section 16B has a substantially straight first run 19A and an arced second run 19B. It will be appreciated that in lieu of the arced portions 17B and 19B, the second angled runs of yoke sections 16A and 16B can be straight, albeit at an angle to the straight runs 17A and 19A. Indeed, in certain cases the upper, second runs could be straight and be at right angles to the first, lower runs.

Figure 2:
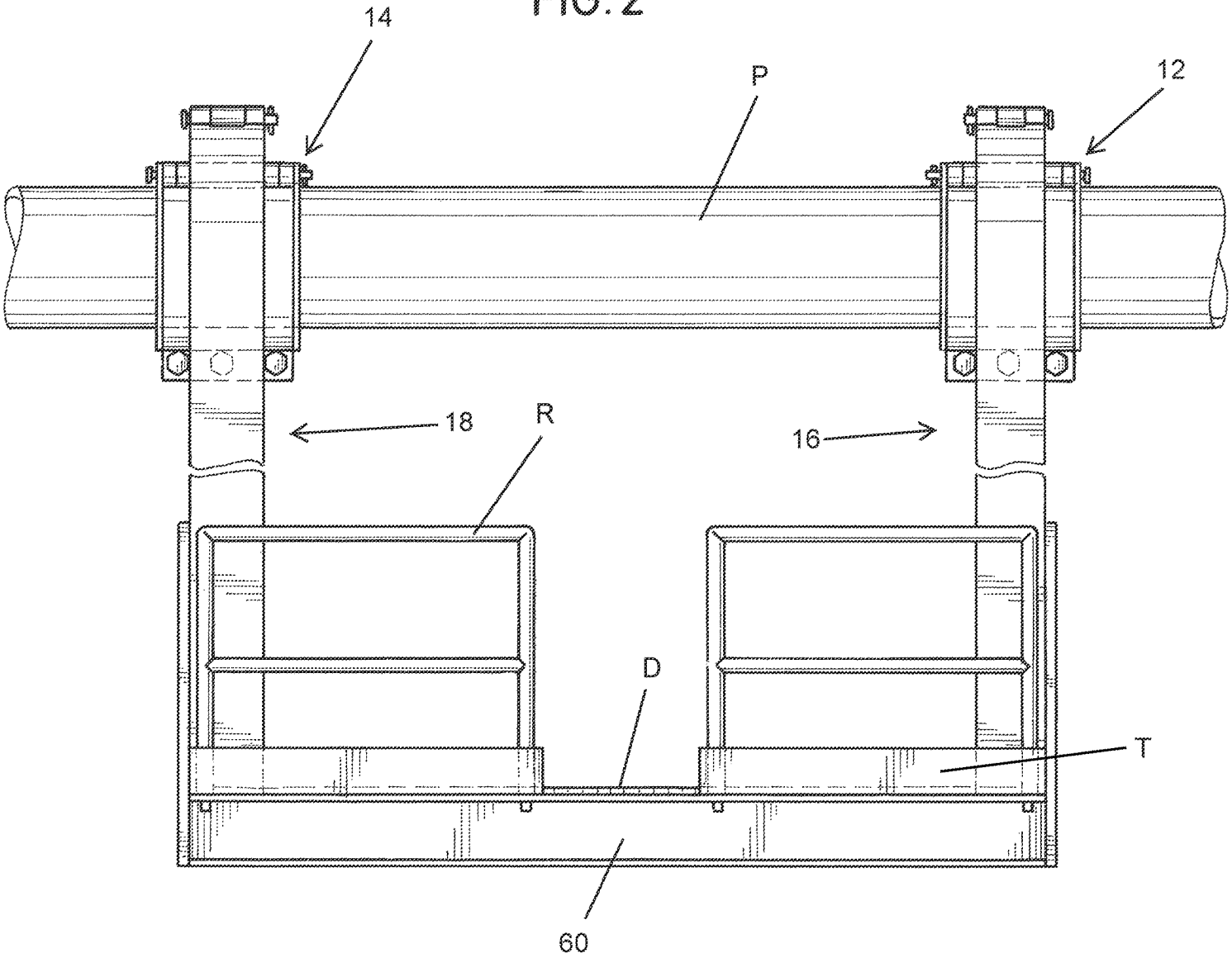
FIG. 2 is a side elevational view of the scaffolding assembly shown in FIG. 1.
Figure 3:
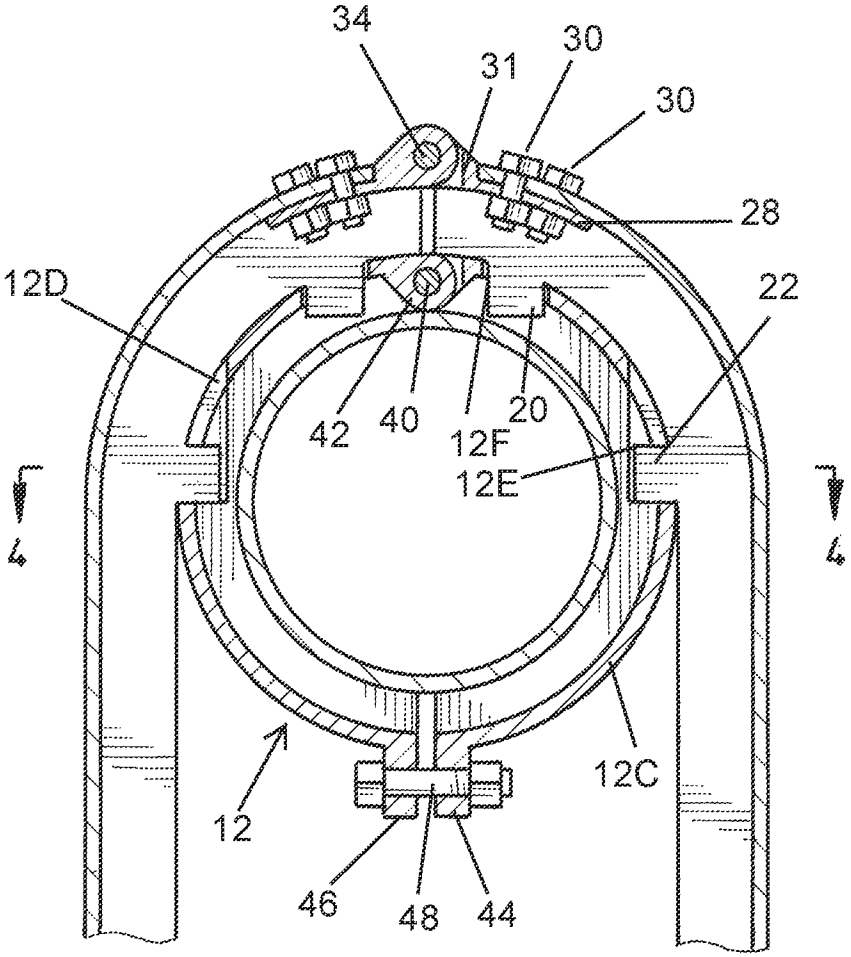
FIG. 3 is a partial elevational view of the scaffolding of FIG. 1, showing in particular an enlarged view of the collar and yoke used in the scaffolding assembly of FIG. 1.

As seen with reference to FIGS. 1-4, each of yoke sections 16A and 16B which are made of a suitable lightweight but strong metal such as aluminum, various alloys, etc. are channel shaped in cross-section. Yoke section 16A has laterally extending tabs 20 and 22. As seen in FIG. 3, hinge connection plate 28 is secured to yoke section 16A by screw bolt assemblies 30, a hinge knuckle 31 having a bore 33 extending laterally outwardly from plate 28.

Figure 4:
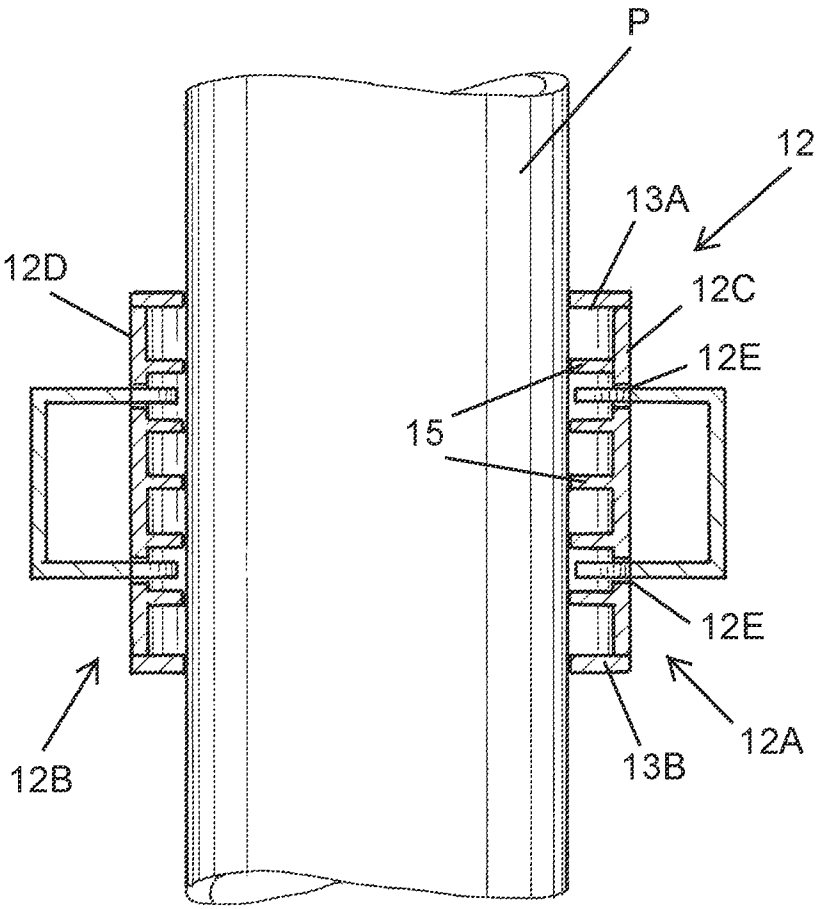
FIG. 4 is a cross-sectional view taken along the lines 4-4 of FIG. 3.

Collar 12 as best seen in FIGS. 3 and 4 is comprised of collar segments 12A and 12B which are basically the same. Each of collar segments 12A and 12B is comprised of an approximately semi-circular outer wall 12C and 12D, respectively. There are radially inwardly extending slots 12E and 12F in outer wall 12C. Collar 12 further comprises end caps 13A and 13B as well as support ribs 15.

Collar segments 12A and 12B each have a hinge connector for receipt of a hinge pin 40 which extends through a registering bore formed by hinge knuckles one of which, 42, is shown in FIG. 3.

Each of collar segments 12A and 12B have a laterally extending flange 44 and 46 which are spaced from one another as shown in FIG. 3, there being registering bores through flanges 44 and 46 for receipt of a nut/bolt assembly 48 such that when collar segments 12A and 12B are placed in surrounding relationship to pipe P and hinge pin 40 is fitted into the bore formed by the hinge knuckles 42, the collar can then be compressed to the desired tightness around pipe P by means of the nut/bolt assembly 48. It should be noted that the hinged connection of collar segments 12A and 12B is generally diametric to the nut/bolt assembly 48. Additionally, since there is space between the flanges 46 and 44, tightening of the nut/bolt connection ensures that the desired degree of compressive force can be exerted by the nut/bolt assembly 48 to ensure a secure gripping of the collar 12 to the pipe P.

Scaffolding assembly 10 is basically comprised of two scaffolding assembly sections $S_1$ and $S_2$, as indicated by the dotted lines on FIG. 1. For brevity, only scaffolding assembly section $S_1$ will be described in detail, it being understood that scaffolding assembly section $S_2$ has substantially the same construction.

Turning now to FIGS. 1 and 2, scaffolding section $S_1$ comprises a platform assembly $P_1$ comprised of a frame $F_1$ which is rectangular and is made of aluminum channel shaped frame members 62 and 60 forming the outside perimeter of frame $F_1$. In addition, frame $F_1$ include joists (not shown) which form part of frame $F_1$ and upon which is overlaid decking D which is secured to the joists. Decking D can be of various types such as expanded aluminum or other commonly used decking materials to form platforms, decks and the like. In addition, platform $P_1$ has toeboard T and railing R generally attached to the top of decking D around the perimeter of the frame F. Platform $P_1$ also includes diagonal braces 70 and removably attached spanners 72 for releasably stabilizing platforms $P_1$ and $P_2$ when connected.

As best seen in FIG. 1, the lower end of yoke section 16A is connected to frame $F_1$. It will be apparent that the components of platforms $P_1$, $P_2$ can be mechanically assembled and thereby easily disassembled, or that parts thereof may be connected by welding or other more permanent connection means. In any event, and as depicted in FIG. 1, when the two scaffolding sections $S_1$ and $S_2$ are assembled, they can be raised as shown in FIG. 1, such that the upper ends of yoke sections 16A and 16B are on either side and slightly above collar 12 which would have been previously installed. Yoke sections 16A and 16B can then be moved laterally inwardly toward one another until tab 20 is directly above slot 12F. At this point, the scaffolding assembly sections $S_1$ and $S_2$ can be lowered until tabs 20 and 22 engage slots 12E and 12F, respectively. It is to be noted that slot 12E is circumferentially elongated, as best seen in FIG. 3, thus allowing the vertical movement of the yoke section 16A directly downwardly to engage the receiving formation or slot 16E on collar segment 12A.

Figure 5:
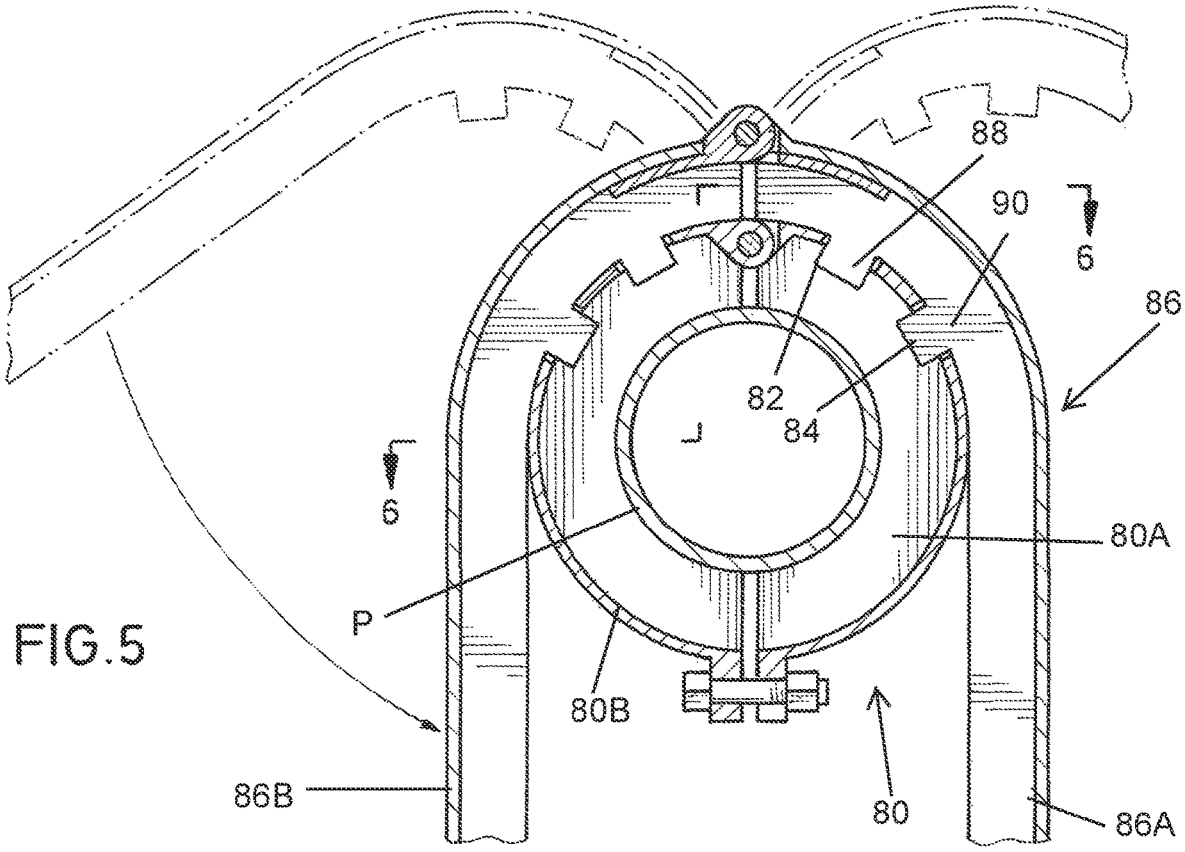
FIG. 5 is a front elevational view of another embodiment of the scaffolding assembly of the present invention.
Figure 6:
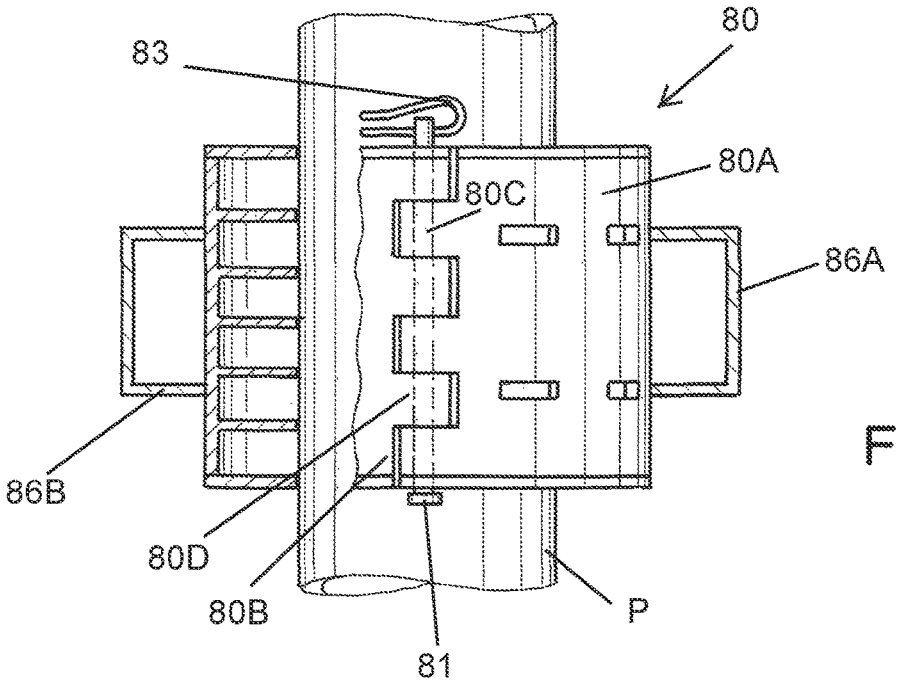
FIG. 6 is a cross-sectional view taken along the lines 6-6 of FIG. 5.

Referring now to FIGS. 5 and 6, there is shown a slight variation of the scaffolding assembly shown in FIGS. 1-4. Collar 80 has collar segments 80A and 80B which are attached as shown in FIG. 5 in surrounding relationship to pipe P. Collar 80 has slots 82 and 84. Yoke 86 has yoke sections 86A and 86B, having tabs 88 and 90. Compared to the embodiment shown in FIG. 3, it can be seen that slot 82 is rotated counterclockwise in position from that of slot 12F in FIG. 3. Similarly, slot 84 is rotated clockwise relative to the position of slot 12E shown in FIG. 3. Thus, as shown in FIG. 5, the yoke sections 86A and 86B must first be hingedly connected to the hinge connectors as shown in FIG. 6 and described hereafter, and the yoke sections rotated downwardly as shown in FIG. 5 so as to allow the tabs 88 and 90 to engage the slots 82 and 84, respectively. This is also true of the engagement of yoke section 86B with collar segment 80B. FIG. 6 shows an enlarged detail of the hinged assembly used to connect collar segments 80A and 80B. As can be seen collar segments 80A and 80B carry interleaved hinge knuckles 80C and 80D, respectively, having bores (shown in phantom) through which a hinge pin 81 extends, a cotter pin 83 being used to prevent back out of hinge pin 81.

Figure 7:
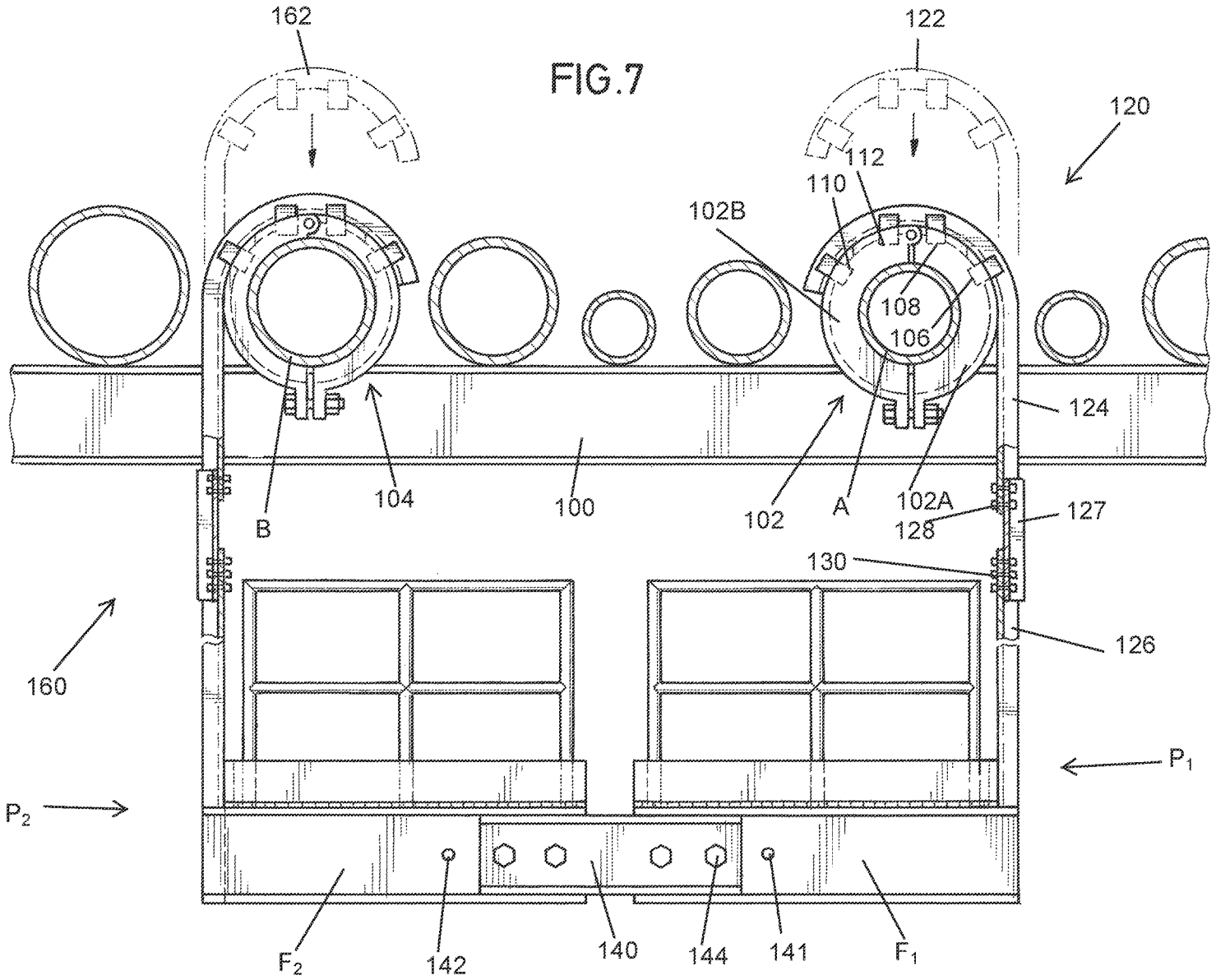
FIG. 7 is a front elevational view of another embodiment of the scaffolding assembly of the present invention shown suspended from two tubular members.
Figure 8:
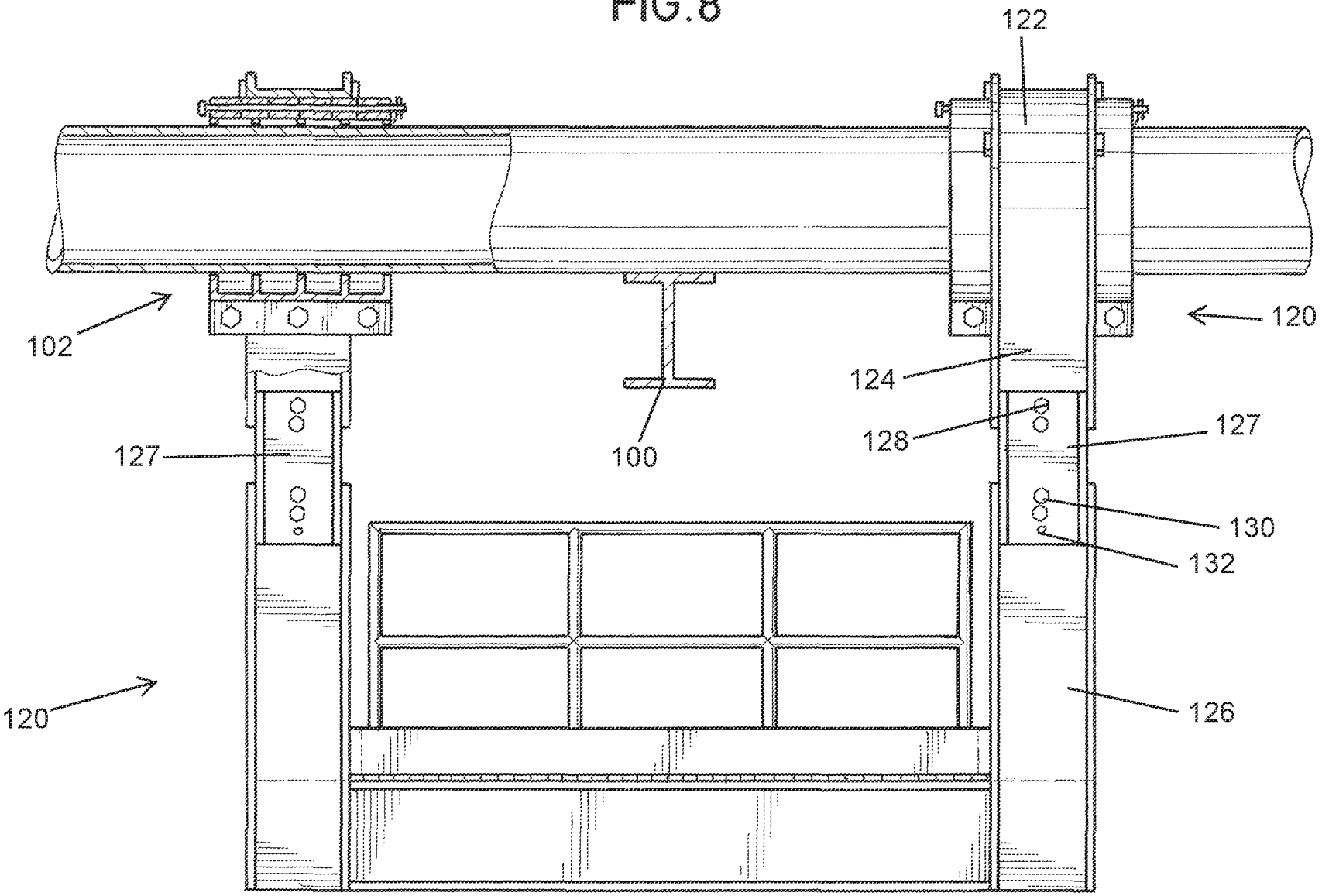
FIG. 8 is a side, elevational view of the scaffolding assembly shown in FIG. 7.

Turning now to FIGS. 7 and 8, there is shown another embodiment of the scaffolding assembly of the present invention. As will be described in detail hereafter, the embodiment of FIGS. 7 and 8 is similar to that described in previous figures, and differs primarily in the fact that the two scaffolding sections are suspended from two different laterally spaced tubular members, e.g., pipes.

Turning then to FIG. 7, there is shown an I-beam 100 forming part of a pipe rack upon which rests in side-by-side relation, a plurality of pipes P of various diameters. The collars used in the embodiments of FIGS. 7 and 8 are substantially the same in construction and operation as the collars described in previous embodiments. Thus, they both have two segments basically the same hinged connection and the same compression assembly to clamp the collar segments to the outside diameter (OD) of the pipe. As in the embodiments described above, there are two separate, releasably connected platform assemblies $P_1$ and $P_2$ and four separate collars. In the embodiment of FIGS. 7 and 8, two of the collars 102 are on pipe A having a first diameter and are axially spaced from one another, while the other two collars 104, also axially spaced from one another, are on a second, laterally spaced pipe B of a larger diameter. Collar 102 has collar segments 102A and 102B, collar segment 102A having receiving formations or slots 106 and 108. Collar segment 102B has receiving formations 110 and 112. As can be seen from FIG. 7, receiving formations 106 and 110 are circumferentially elongated slots.

A hook assembly 120 has an upper arcuate shaped section 122, an intermediate straight portion 124, and a lower straight portion 126. Portions 124 and 126 are adjustably interconnected by an expander bar 127, bar 127 being connected to portion 124 by nut/bolt assemblies 128 and to portion 126 by nut/bolt assemblies 130 received in holes 132. As seen in FIG. 8, the number of holes 132 can vary allowing lengthening or shortening of hook assembly 120.

As noted, the embodiment of FIGS. 7 and 8 comprises two platforms shown as $P_1$ and $P_2$. Platforms $P_1$ and $P_2$ can be releasably connected to each other at a desired distance by the use of an expander bar 140 and nut/bolt assembly 144. In this regard, frame $F_1$ of platform $P_1$ has a series of spaced holes 141 while frame $F_2$ of platform $P_2$ has a series of spaced holes 142. By selecting the desired holes in the frames $F_1$ and $F_2$, it will be seen that the distance between platforms $P_1$ and $P_2$ can be varied as desired.

Collar 104 is similar to collar 102 but differs in that it has a lesser radial thickness to accommodate the fact that the diameter of pipe B is greater than the diameter of pipe A. This ensures that the ODs of collar assemblies 102 and 104 which connect to the pipes A and B have the same OD albeit being on different diameter pipes as seen in FIG. 7.

As can be seen, when the arced or hook shaped portions 122 and 162 of hooks 120 and 160 are positioned above collars 102 and 104, the platforms $P_1$ and $P_2$ can be lowered until the tabs on arced sections 122 and 162 engage the slots on collars 102 and 104.

Figure 9:
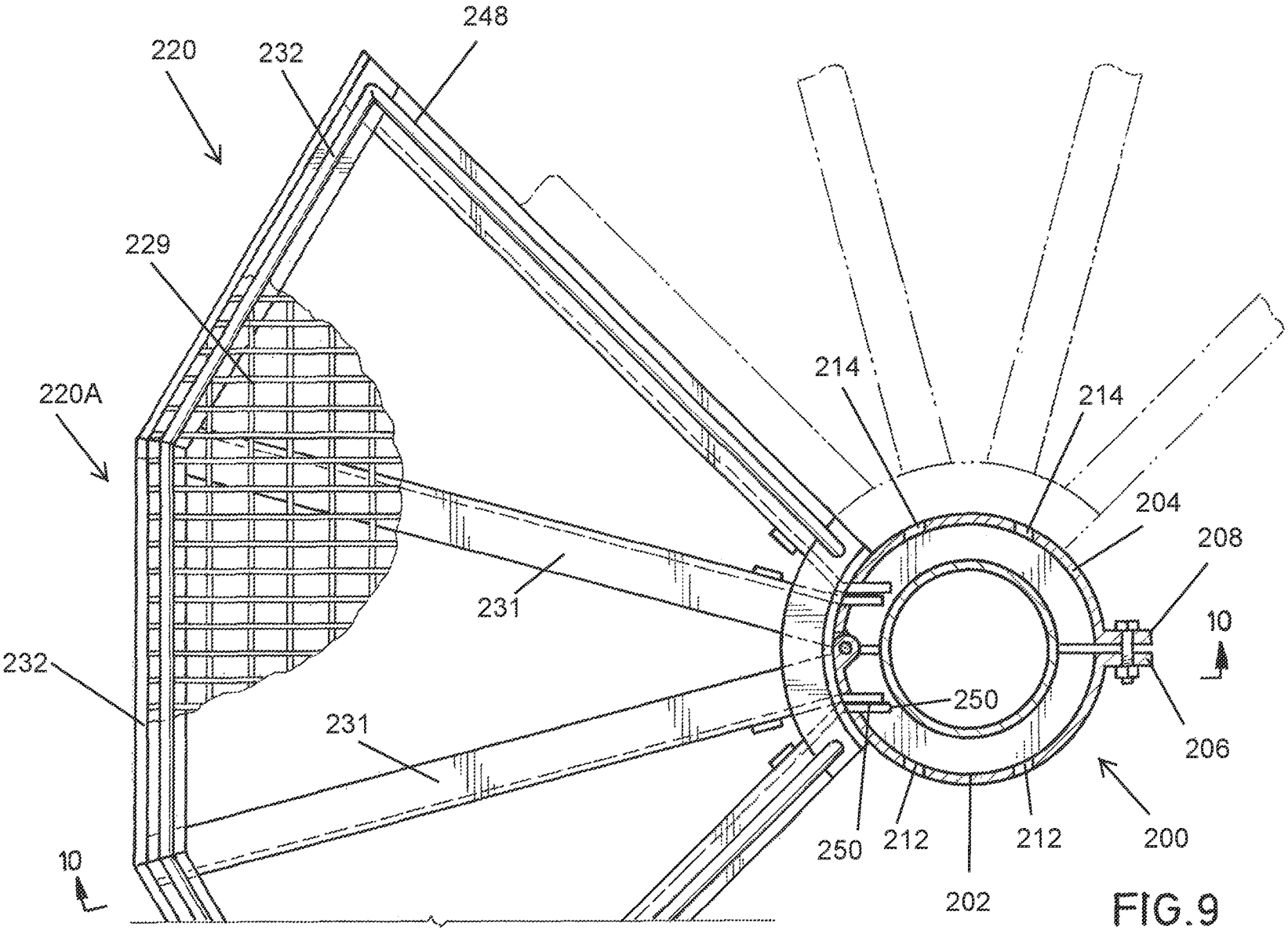
FIG. 9 is a top, plan view, partially broken away, showing another embodiment of the scaffolding assembly of the present invention attached to a tubular member.
Figures 10, 10A:
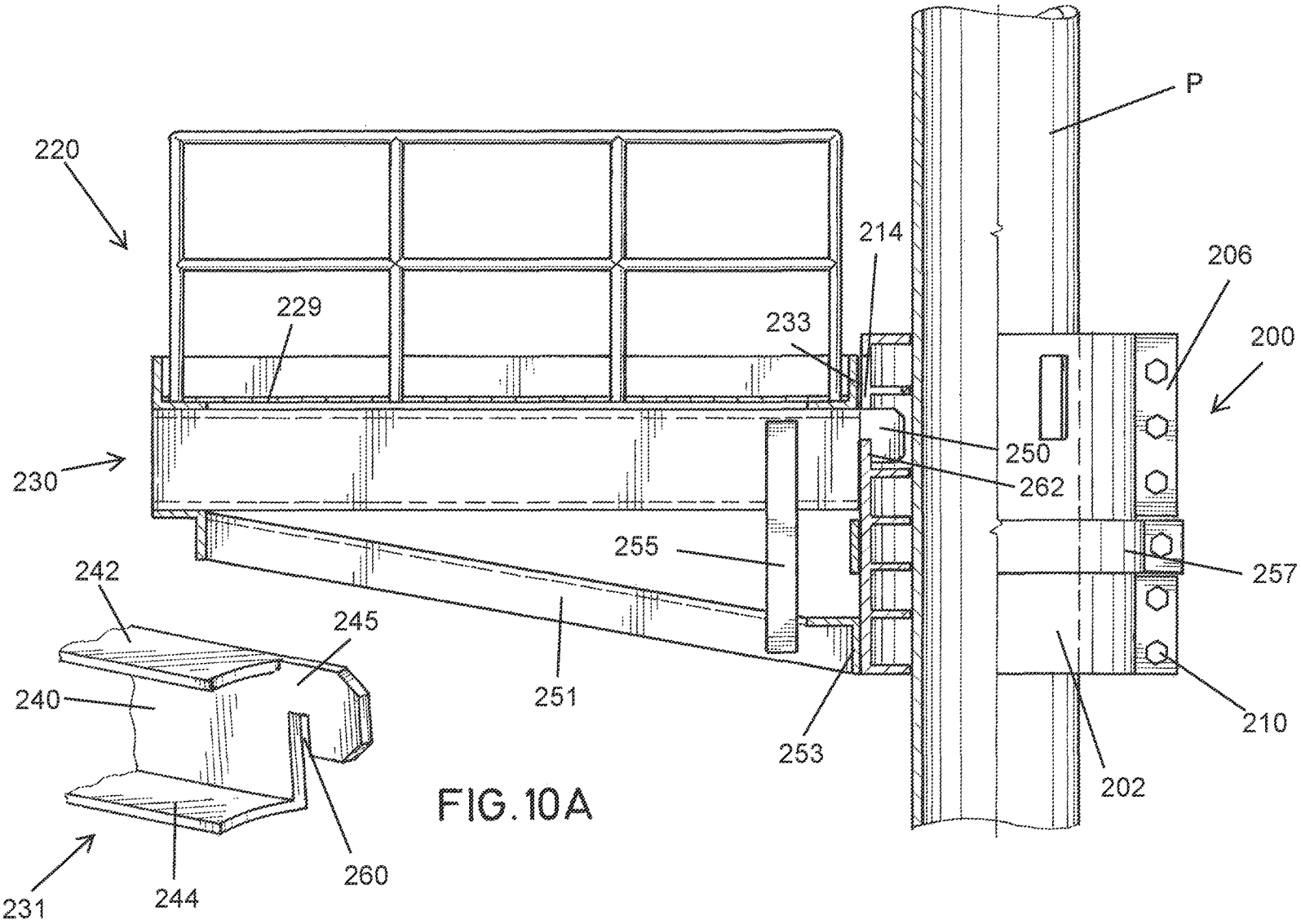
FIG. 10 is a side elevational view, partly in section, of the scaffolding assembly shown in FIG. 9.
FIG. 10A is an isometric view of a connector used in the scaffolding assembly of FIG. 10.

Referring now to FIGS. 9 and 10, there is shown another embodiment of the present invention, wherein the scaffolding assembly is connected to a vertical pipe. A collar assembly shown generally as 200 comprises collar segments 202 and 204. Collar segment 202 has flange 206 while collar segment 204 has flange 208. Flanges 206 and 208 are connected to one another by means of nut/bolt assemblies 210 whereby the compressive force on pipe P can be varied. Collar segment 202 has a first series of circumferentially spaced apertures 212 while collar segment 204 has a second series of spaced apertures 214. A hinge assembly 218 substantially the same as the hinge connection described above also connects collar segments 202 and 204.

There is a platform assembly shown generally as 220 having a frame shown generally as 230. Frame 230 is comprised of aluminum channels 231 welded together to form three triangular shaped sections 232 which are in turn welded together to form a platform framework. A platform surface 229 of expandable metal or the like is welded to the aluminum channel framework to form a platform surface. Sections of aluminum angle welded to the platform surface form a toeboard perimeter 248.

The term "formation" or "formations" as used herein with respect to connection or connectors between the platforms and the collars is intended to include any opening(s), projection(s), object(s) of whatever shape or configuration on one structure which in cooperation with another formation, as just defined, on another structure can effect releasable connection of the two structures, e.g., a collar and a platform assembly.

The term "asymmetrical" with respect to the head of the cam rod is intended to mean a shape which as has at least two dimensions, one of which is longer than the other such that a body having such an asymmetrical shape can be received into an asymmetrical opening (as defined) when the long dimension of the asymmetrical body is in register with or aligns with the long dimension of the asymmetrical opening and such that once received in the asymmetrical opening, and rotated such that the long dimension of the asymmetrical body is transverse to the long dimension of the asymmetrical opening, i.e., the asymmetrical body cannot be pulled back through the asymmetrical opening without again rotating the body until the long dimension of the body is again aligned with the long dimension of the opening.

The aluminum channels 231, as shown in FIG. 10 have a bottom wall 240, and first and second side walls 242 and 244. As seen in FIG. 10A, the bottom wall 240 projects radially inwardly to form a hook-shaped end 245 having a slot 260. As best seen in FIG. 9, the hook-shaped ends 245 can be welded together to form a projecting hook formation 250, the hook formations 250 being circumferentially spaced. The channels 231 are also welded to an arcuate section of aluminum angle 233 on the inner periphery of platform 230. Platform assembly 220 also has one or more struts 251 welded on one end to the periphery of the frame 230, the strut 251 having a second end forming a head 253. Channel 231 and strut 251 are connected by beam 255. Optionally, a strap 257 can be placed around and secured to collar 200 for more structural integrity.

To attach platform 220 to collar 200, platform 220 is raised until formations 250 are in register with apertures 214 and the slots 260 in formation 250 are in register with the lip 262 formed by the outer wall of collar 200. Platform 220 is then lowered whereupon lip 262 engages slot 260 and head 253 rests against the wall of collar 200.

Figure 11:
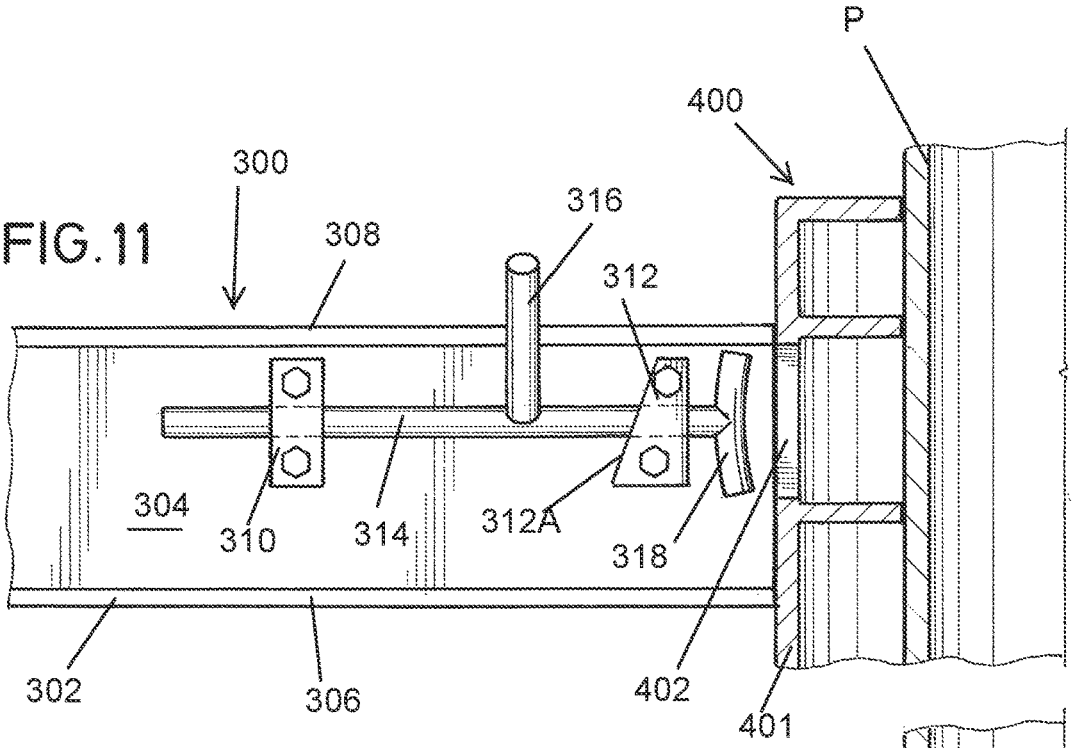
FIG. 11 is a side elevational view, partly in section, of a connector system used in one embodiment of the scaffolding assembly of the present invention.
Figure 12:
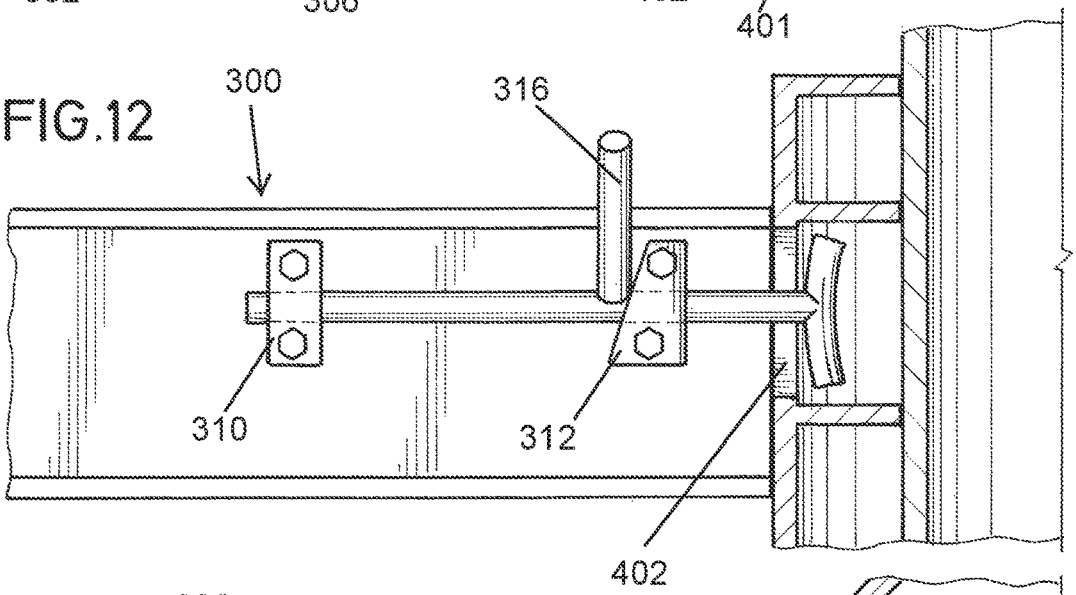
FIG. 12 is a view similar to FIG. 11 showing the connector assembly in a second position.
Figure 13:
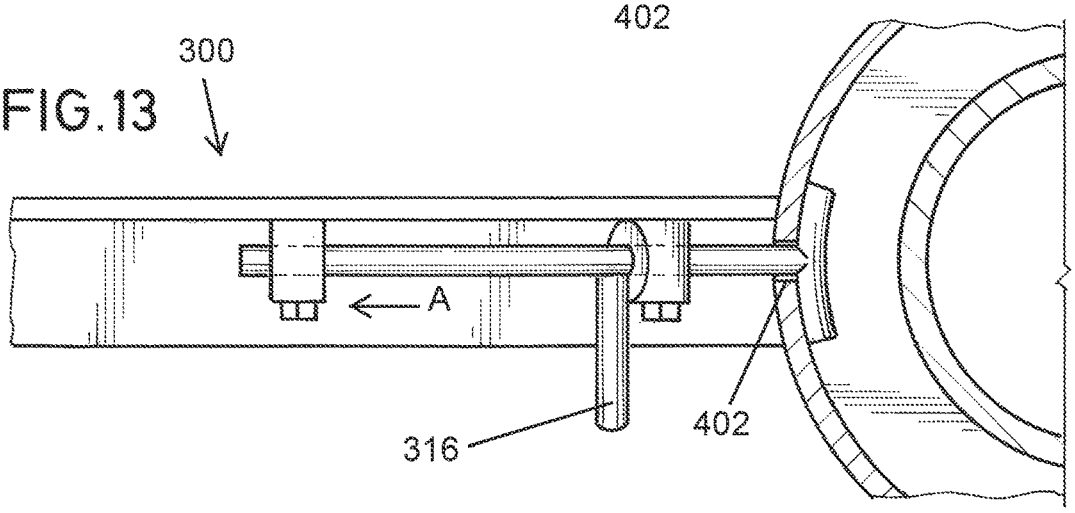
FIG. 13 is a view of the connector shown in FIG. 12 rotated and moved into an engaged position.

Referring now to FIGS. 11-13, there is shown an alternate embodiment of connecting a platform such as platform 220 to a collar such as collar 200. The platform 300, only a portion of which is shown in FIGS. 11-13, comprises frame members 302 which cooperate with other framing to form a platform substructure generally as shown in FIGS. 9, 10, and 10A. The frame members 302 have the configuration shown in FIG. 10A with respect to the side walls and the bottom wall. Thus, frame member 302 comprises bottom wall 304, side wall 306, and second side wall 308. Secured to bottom wall 304 by screws are first and second shaft mounts 310 and 312. Slidably mounted in registering bores in shaft mounts 310 and 312 is a cam rod 314 having a laterally extending handle/cam follower 316. A head 318 formed/welded on the inner end of cam rod 314 is formed by a slightly bowed section of the same material from which cam rod 314 is made. Thus, as seen in FIG. 11, a T-shaped member is formed.

Collar 400 which is secured to pipe P has the same basic construction as the other collars described above. However, collar 400 has a plurality of circumferentially displaced elongate slots 402. To help secure platform assembly 300 to collar 400, rod 314 is moved to the position shown in FIG. 12 whereupon cam follower 316 engages the camming surface 312A formed on shaft mount 312. It will be recognized that slot 402 is asymmetrically shaped and can be of many shapes, but in the configuration shown in FIGS. 11-13, it is generally an elongate slot which substantially corresponds to the shape of head 318. Thus, as seen in FIG. 12, when rod 314 is moved from the position shown in FIG. 11 to the position shown in FIG. 12, asymmetric head 318 which is in register with slot 402 can move through slot 402. Once positioned as shown in FIG. 12, rod 314 can then be rotated which will force cam follower 316 against cam surface 312A thereby forcing rod 314 in the direction of arrow A as shown in FIG. 13, forcing head 318 against the inner surface of wall 401 of collar 400. It will be recognized that platform 300 will have the structural features as discussed above such as one or more struts to ensure that the platform 300 is rigidly secured to collar 400 and hence to pipe P.

Figure 14:
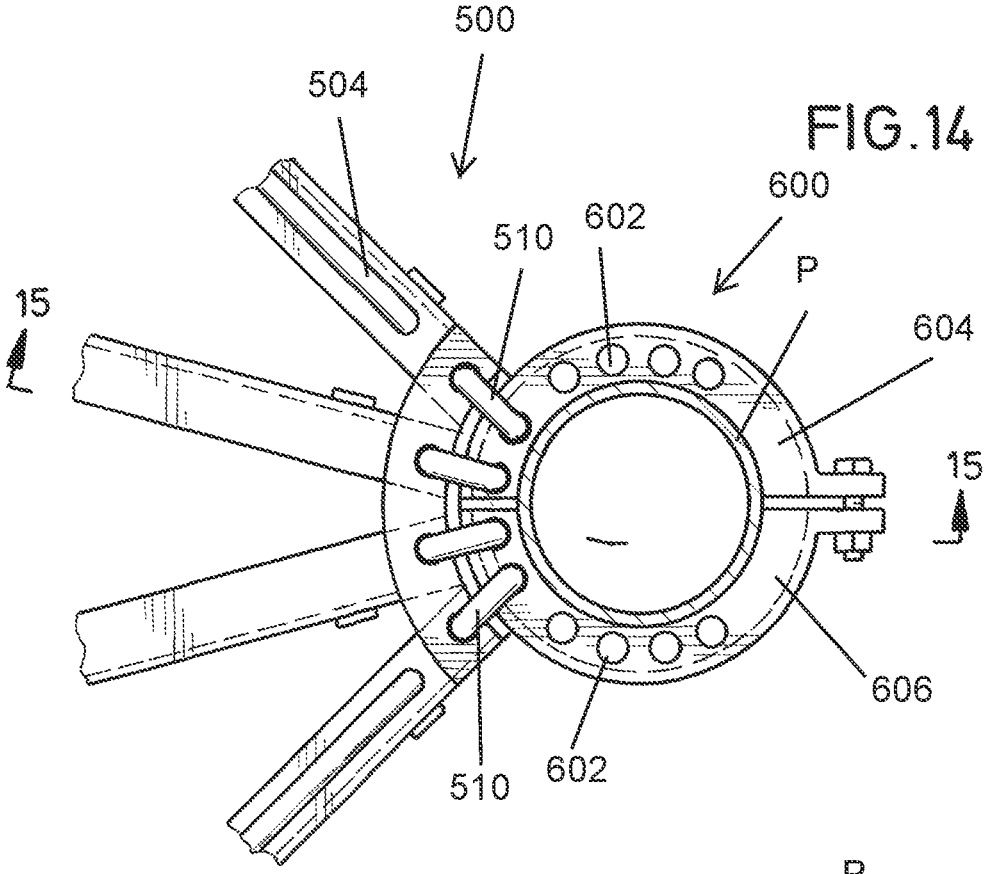
FIG. 14 is a partial, top, plan view of another embodiment of the scaffolding assembly of the present invention.
Figure 15:
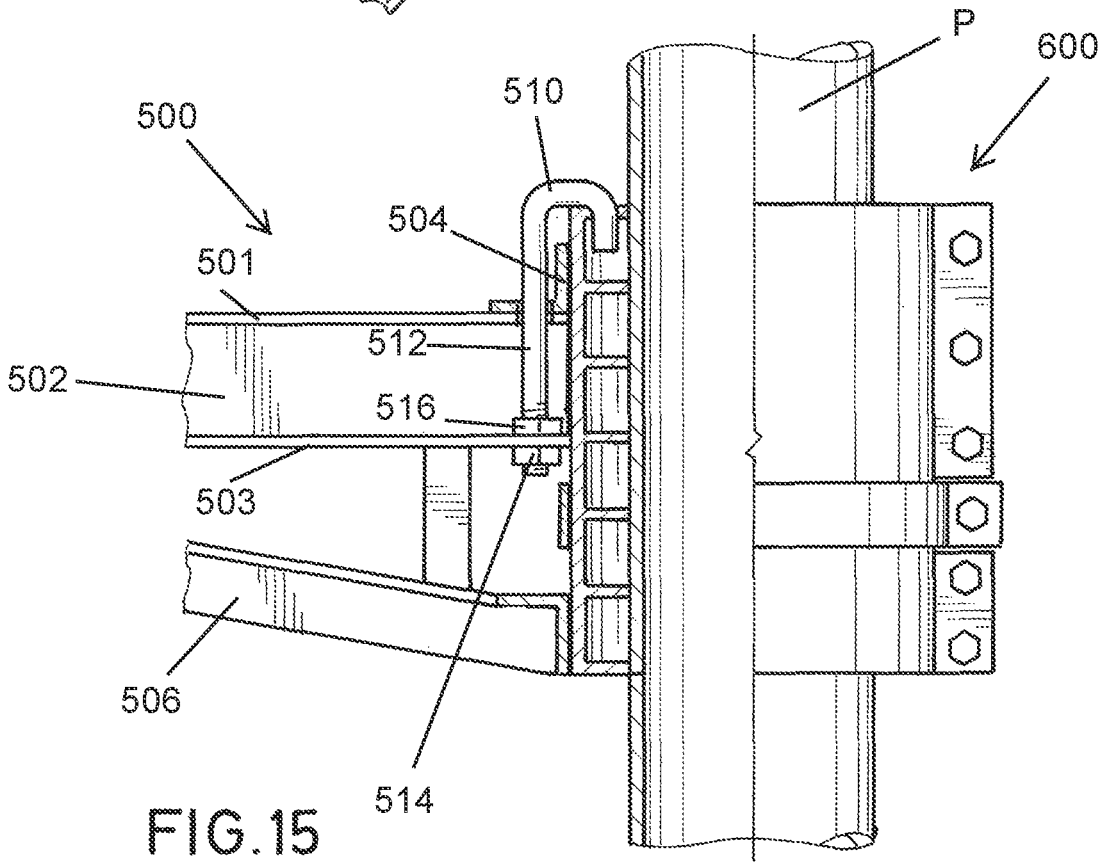
FIG. 15 is a cross-sectional view taken along the lines 15-15 of FIG. 14.

Turning now to FIGS. 14 and 15 there is shown another connector assembly for attaching a platform assembly, a portion of which is shown generally as 500 to a collar 600. Collar 600 has collar segments as described above and is secured in the same manner as described above to a vertical pipe P.

Collar 600 has a plurality of circumferentially spaced sockets 602 in the end walls 604 and 606 of the collar segments making up collar 600.

Platform assembly 500 is again basically the same as the other platforms described above in terms of its structural features and accordingly has a framework made of channel pieces 502 welded to toeboard 504 and has an inner periphery which engages collar 600. Platform assembly 500, as in the case of the other platforms described above, also has a strut 506 which releasably engages the outer wall of collar 600. A plurality of J-hooks are attached to platform 500. More specifically, as shown in FIGS. 14 and 15, each J-hook has a shank 512 which extends through registering bores in side walls 501 and 503 of frame member 502, a lock nut arrangement 514, 516 being used to securely hold the shank 512 of J-hook 510 in the frame member 502. The upper end of the J-shaped portion of hook 510, as shown in FIG. 15, extends radially inwardly of the inner periphery of platform assembly 500.

To connect platform 500 to collar 600, platform 500 would be raised until the J-shaped portions of J-hooks 510 are above upper end wall 604 of collar 600. Since the bores 602 are circumferentially spaced as to be in register with the free ends of the J-shaped portions, platform 500 can then be lowered whereupon the free ends of the J-hooks will engage the sockets while the struts 506 will engage the outer wall of the collar 600, thereby securing platform 500 to collar 600 and hence to pipe P.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A scaffolding assembly suspendable from an elongate support comprising:

a first split collar adapted to be attached in surrounding relationship to said support at a first location;

a second split collar adapted to be attached in surrounding relationship to said support at a second location axially spaced from said first location;

a first platform;

a first yoke section having a lower end and an upper arced portion;

a second yoke section having a lower end and an upper arced portion, said lower ends of said first and second yoke sections being connectable to said first platform at axially spaced locations;

a second platform;

a third yoke section having a lower end and an upper arced portion;

a fourth yoke section having a lower end and an upper arced portion, said lower ends of said third and fourth yoke sections being connectable to said second platform at axially spaced locations;

said upper arced portions of said first and second yoke sections being releasably connectable to the upper arced portions of said third and fourth yoke sections, respectively, when the upper arced portions of said first and third yoke sections and the upper arced portions of said second and fourth yoke sections are received on said first and second split collars, respectively, whereby projecting formations on said first and third yoke sections are received in receiving formations on said first split collar, and projecting formations on said second and fourth yoke sections are received in receiving formations on said second split collar.

2. The scaffolding assembly of claim 1, wherein said first split collar when attached to said support has a first portion positioned on a first side of said support, and a second portion positioned on a second opposite side of said support, said first and second split collar portions being hingedly connected to one another at a first position above said support and adjustably connected to one another at a second position below said support.

3. The scaffolding assembly of claim 2, wherein said second split collar when attached to said support has a first portion positioned on a first side of said support, and a second portion positioned on a second opposite side of said support, said first and second portions of said second split collar being hingedly connected to one another at a third position above said support and adjustably connected to one another at a fourth position below said support.

4. The scaffolding assembly of claim 1, wherein said first split collar comprises first and second halves, each of said first and second halves of said first split collar having a radially outer surface, each of said first and second radial outer surfaces of said first split collar having at least one radially outwardly opening recess, and said second split collar comprises first and second halves, each of said first and second halves of said second split collar having a radially outer surface, each of said first and second radial outer surfaces of said second split collar having at least one radially outwardly opening recess.

5. The scaffolding assembly of claim 4, wherein said upper arced portion of said first yoke section has at least one tab extending radially inwardly, and said upper arced portion of said third yoke section has at least one tab extending radially inwardly, said tab on said first yoke section and said tab on said third yoke section being received in said first and second recesses, respectively, of said first split collar when said first yoke section and said third yoke section are received on said first and second halves of said first split collar, respectively.

6. The scaffolding assembly of claim 5, wherein said upper arced portion of said second yoke section has at least one tab extending radially inwardly, and said upper arced portion of said fourth yoke section has at least one tab extending radially inwardly, said tab on said second yoke section and said tab on said fourth yoke section being received in said first and second recesses, respectively, of said second split collar when said second yoke section and said fourth yoke section are received on said first and second halves of said second split collar, respectively.

7. The scaffolding assembly of claim 5, wherein said upper arced portions of said first and third yoke sections are releasably hingedly connected to one another.

8. The scaffolding assembly of claim 5, wherein said upper arced portions of said second and fourth yoke sections are releasably hingedly connected to one another.

9. The scaffolding assembly of claim 8, wherein each of said first and second collar halves of each of said first and second collars comprise a radiused outer wall and first and second end plates, each of said first and second halves of said first and second collars having a first recess proximal said hinged connection and a second recess elongate relative to said first recess, said second recess being circumferentially spaced from said first recess.

10. A scaffolding assembly suspendable from a support comprising:

a first split collar adapted to be attached in surrounding relationship to said support at a first location;

a second split collar adapted to be attached in surrounding relationship to said support at a second location axially spaced from said first location;

a first platform;

a first yoke section having a lower portion forming a first run and an upper portion forming a second run, said second run being at an angle to said first run;

a second yoke section having a lower portion forming a third run and an upper portion forming a fourth run, said fourth run being at an angle to said third run, said lower portions of said first and second yoke sections being connectable to said first platform at axially spaced locations;

a second platform;

a third yoke section having a lower portion forming a fifth run and an upper portion forming a sixth run, said sixth run being at an angle to said fifth run;

a fourth yoke section having a lower portion forming a seventh run and an upper portion forming an eighth run, said eighth run being at an angle to said seventh run, said lower portions of said third and fourth yoke sections being connectable to said second platform at axially spaced locations;

said upper portions of said first and second yoke sections being releasably connectable to the upper portions of said third and fourth yoke sections, respectively, when the upper portions of said first and third yoke sections and the upper portions of said second and fourth yoke sections are received on said first and second split collars, respectively, whereby projecting formations on said first and third yoke sections are received in receiving formations on said first split collar, and projecting formations on said second and fourth yoke sections are received in receiving formations on said second split collar.

11. The scaffolding assembly of claim 10, wherein said upper portions of said yoke sections are arced.

* * * * *